US008800444B2

(12) United States Patent
Silberbauer

(10) Patent No.: US 8,800,444 B2
(45) Date of Patent: Aug. 12, 2014

(54) METHOD FOR OPERATING A TRANSPORT SYSTEM

(75) Inventor: Guenther Silberbauer, Uerkheim (CH)

(73) Assignee: Mueller Martini Holding AG, Hergiswil (CH)

( * ) Notice: Subject to any disclaimer, the term of this patent is extended or adjusted under 35 U.S.C. 154(b) by 363 days.

(21) Appl. No.: 13/309,062

(22) Filed: Dec. 1, 2011

(65) Prior Publication Data

US 2012/0139178 A1 Jun. 7, 2012

(30) Foreign Application Priority Data

Dec. 1, 2010 (CH) ..... 2019/10

(51) Int. Cl.

| | |
|---|---|
| ***B41F 17/00*** | (2006.01) |
| ***B41F 13/56*** | (2006.01) |
| ***B65H 29/66*** | (2006.01) |
| ***B65H 45/22*** | (2006.01) |
| ***B65H 29/60*** | (2006.01) |
| ***B65H 39/02*** | (2006.01) |
| ***B65H 39/10*** | (2006.01) |
| ***B65H 5/32*** | (2006.01) |
| *B42B 9/04* | (2006.01) |
| *B42C 19/02* | (2006.01) |
| *B42C 1/12* | (2006.01) |

(52) U.S. Cl.

CPC . *B65H 45/22* (2013.01); *B42B 9/04* (2013.01); *B42C 19/02* (2013.01); *B65H 29/66* (2013.01); *B65H 2301/4351* (2013.01); *B65H 2301/436* (2013.01); *B65H 29/60* (2013.01); *B65H 39/02* (2013.01); *B42C 1/12* (2013.01); *B65H 39/10* (2013.01); *B65H 2301/4312* (2013.01); *B65H 5/32* (2013.01); *B65H 2601/422* (2013.01); *B65H 2301/449* (2013.01)

USPC ..... 101/227; 270/21.1; 493/357

(58) Field of Classification Search

USPC ..... 493/23, 28, 187, 243, 244, 249, 320, 493/357, 421; 270/20.1, 21.1, 37, 52.09, 270/58.08; 101/226, 227

See application file for complete search history.

(56) References Cited

U.S. PATENT DOCUMENTS

| | | | | |
|---|---|---|---|---|
| 3,977,665 | A * | 8/1976 | Bowman et al. | 270/4 |
| 4,533,132 | A | 8/1985 | Wangermann | |
| 2002/0042333 | A1 * | 4/2002 | Boss | 493/413 |
| 2004/0214707 | A1 | 10/2004 | Stocklossa et al. | |
| 2010/0201056 | A1 * | 8/2010 | Dawley | 270/21.1 |
| 2011/0079159 | A1 | 4/2011 | Silberbauer et al. | |
| 2011/0098169 | A1 | 4/2011 | Grunder et al. | |

FOREIGN PATENT DOCUMENTS

| | | | |
|---|---|---|---|
| EP | 1 197 456 | A1 | 10/2000 |
| EP | 1 270 479 | A1 | 6/2001 |

(Continued)

OTHER PUBLICATIONS

International Search Report of CH 20192010 Filed Mar. 17, 2011 With an English Translation.

*Primary Examiner* — Ren Yan

(74) *Attorney, Agent, or Firm* — Venable LLP; Robert Kinberg; F. Brock Riggs

(57) ABSTRACT

With a method for operating a transport system, used in the production of printed products composed of signatures or printed sheets, at least one first conveying belt is provided downstream of a printing press designed for producing the signatures or printed sheets. Further downstream, this conveying belt is divided into at least two individually operating conveying paths, wherein at the end of each of the conveying paths the transported signatures or printed sheets are supplied while positioned straddling and via a continuously operating folding device to at least one intermediate gathering device. For the further transport, the signatures or printed sheets are transferred from the gathering device in a serial, monotonous, intermittent, synchronous or non-synchronous sequence to a main conveying section. The signatures or printed sheets which are combined to form partial book blocks or complete book blocks are then wire-stapled, thread-stitched or bound with adhesive.

11 Claims, 1 Drawing Sheet

(56) References Cited

FOREIGN PATENT DOCUMENTS

| | | | |
|---|---|---|---|
| EP | 1 334 938 | A1 | 2/2002 |
| EP | 1288015 | A1 * | 3/2003 |
| EP | 1 764 232 | A1 | 9/2005 |
| GB | 2 356 189 | A | 5/2001 |
| JP | 5-294087 | | 11/1993 |
| WO | WO-2005/072980 | | 8/2005 |

* cited by examiner

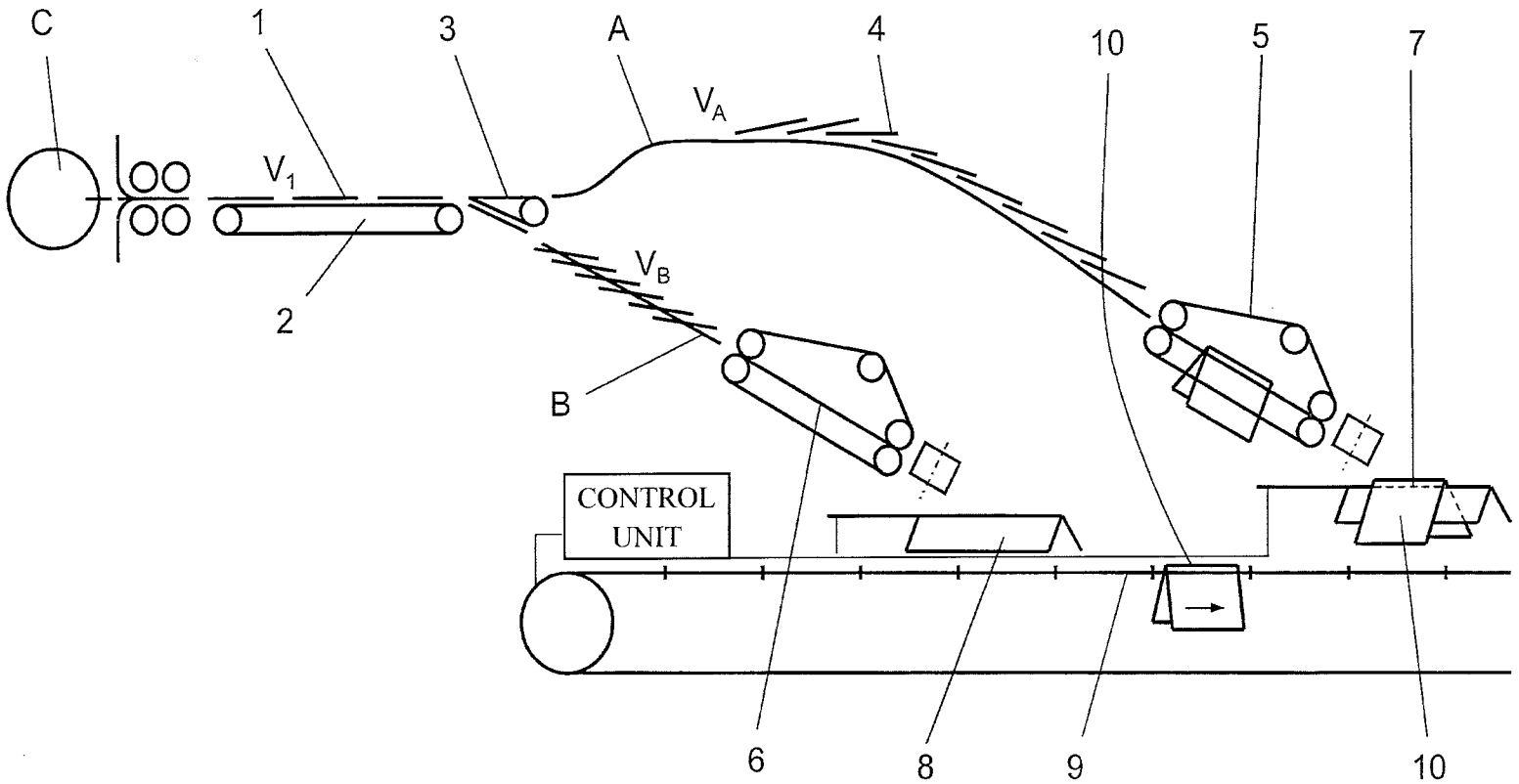
C
1
$V_1$
2
3
A
$V_A$
4
10
5
7
$V_B$
B
6
8
9
10
CONTROL UNIT

METHOD FOR OPERATING A TRANSPORT SYSTEM

CROSS-REFERENCE TO RELATED APPLICATION

This application claims the priority of the Swiss Patent Application No. 02019/10, filed on Dec. 1, 2010, the subject matter of which is incorporated herein by reference.

BACKGROUND OF THE INVENTION

The present invention relates to a method for operating a transport system for printed products composed of printed sheets or signature.

The European patent document EP 1 334 938 A1 discloses a device for producing bound printed products. To produce these products, individual printed sheets are supplied to a continuously operating folding device and are folded therein. The folded sheets or signatures are then gathered in a gathering device to form a pre-product and are transferred to a transport device. The gathering device is provided with a sword, essentially extending parallel to the transporting direction of the transport device, on which respectively a predetermined number of signatures are gathered to form a pre-product.

The European patent document EP 1 270 479 A1 discloses a method for producing a print item which is composed of several printed products, gathered while positioned straddling. The printed products used to form a printed item are collected in a predetermined sequence along a joint path and are then stitched together. An intermittently circulating support surface is provided, which is supplied by a feeding device with printed products that are positioned straddling.

In the known prior art, the folded signatures must be gathered in a gathering device and must then be transferred to a transport device. Further, the signatures which are processed while moving through a continuously operating folding device in which the sheets are provided with a fold pointing in the movement direction of the conveying path, must be processed as individual sheets or signatures for the purpose of a precise separation between the products. Thus, an efficient conveying operation, for example with the aid of an overlapping flow, is inherently not possible or is possible only under difficult conditions.

It is correct per se that the conveying of individual sheets has a tendency to lead to high cycle rates and consequently also to high transport speeds. However, it must be taken into consideration that in particular the goal of achieving a high speed makes it necessary to insert gaps between the signatures into which the separating sword can dip, as is disclosed in the above mentioned EP1 334 938 A1.

In addition, it is recognized that the high conveying speeds of the signatures in the movement direction must ultimately be stopped abruptly by a front end stop for the further processing, wherein this regularly results in damage to the signatures. Problems with quality are thus encountered during the further processing of the signatures to finished products since this damage takes the form of tears and compressions, especially in the spinal region, thereby causing a noticeable increase in the associated ejection rate.

SUMMARY OF THE INVENTION

It is the object of the present invention to provide a method for operating a transport system which can correct the above-mentioned disadvantages while still maintaining an extremely high cycle rate and a high product-related flexibility.

The above and other objects are achieved according to the invention by the provision of a method to transport printed products composed of printed sheets or signatures, which in one embodiment includes: producing printing products with the use of a printing press; transporting the printed products with at least one first conveying belt operative downstream of the printing press along a conveying path; dividing the conveying path into at least two individually operating conveying paths at a branching location downstream from the at least one conveying belt; folding the respective printed products with at least one continuously operating folding device located at the end of each individually operating conveying path; transferring the folded printed products from the folding devices in a straddling position to corresponding intermediate gathering devices; and transferring the straddling folded printed products from the intermediate gathering devices to a main conveying section in a serial, monotonous, intermittent, synchronous or non-synchronous sequence for further transport.

The method according to the invention thus initially ensures that an extremely high number of items produced by the printing press is caught and can be channeled directly into the further transport paths.

Taking this measure simultaneously results in the advantage that the signatures can also be guided as needed in an overlapping flow along the individual conveying paths, wherein this substantially increases the transport volume per unit of time. However, a transport of individual signatures and/or individual sheets is still possible without problem.

A transport system with two conveying paths, wherein additional parallel or sequentially arranged conveying paths can be added as needed, results in the advantage according to the invention that the individual conveying paths can be embodied differently, relative to each other, and that the conveying speeds along the individual conveying paths can be specified individually. On the whole, this contributes to making it possible for the transport system to operate with maximum flexibility with respect to the conveying speed along the individual conveying paths for the signatures and/or the printed products in general and with respect to the further processing of the signatures to form partial book blocks or complete book blocks, as well as the sequence of the individual signatures or sheets relative to each other.

In connection with a maximized printing operation, the invention also provides for a flexible adaptation of the conveying speeds of the individual conveying paths, relative to each other, wherein the speeds of the individual conveying paths are definitely kept lower than the speed along the first conveying belt immediately downstream of the printing press.

At the end of each of the separate conveying paths that follow the branching location, the signatures transported thereon while positioned straddling are transported with the aid of a continuously operating folding device to intermediate gathering devices which can also function, if necessary, as collecting stations, such that the signatures can then be conveyed further according to specified criteria and sequences.

The forwarding of the signatures by the last-mentioned collecting station can occur either serially, monotonous, intermittent, synchronous or non-synchronous via a main conveying path which serves the operating regions of the continuously operating folding devices that are provided. These continuously operating folding devices, each of which is operatively connected to the associated conveying path, are preferably arranged one behind the other, wherein the following definitions refer to the type and manner in which the signatures are forwarded.

The term serially monotonous refers to a further conveying of signatures which takes place independent of other interdependencies within the transport system, meaning the further conveying is conforming and remains the same over time.

Intermittently means that the products are forwarded on demand and that the intervals for the conveying on demand can differ, meaning a further conveying takes place as needed.

Synchronous is intended to express that there are interdependencies with other conveying elements within the transport system and that not maintaining the cycle rate as a rule leads to an incorrect composition of the finished printed product.

The term non-synchronous means that the transport system operates with a basic, timed conveying speed, to be sure, but that this basic conveying speed does not apply absolutely to all involved conveying elements. For example, individual supplements or inserts can be supplied in a non-synchronous manner to the individual conveying paths.

A transport system of this type consequently is configured as a tandem-type system, regardless of the further conveying mode, which ensures in all cases an extremely efficient conveying of the signatures and/or the individual printed sheets to further processing locations. The gathering and combining of the signatures or the individual sheets to form a partial book block or a complete book block can then take place with the aid of wire stapling, thread stitching, adhesive application or a combination thereof.

In summary, the transport system according to the invention can be characterized as follows:

The signatures or printed sheets are initially transported in a linear direction on a first transport belt which operates immediately downstream of the printing press, until they reach a first branching location where the product flow is first divided into at least two separate conveying paths. The aforementioned printed products are preferably, but not exclusively, conveyed in the form of overlapping flows along these conveying paths. On the one hand, the speeds of the two product flows formed in this way differ relative to each other while, on the other hand, these product-flow speeds are lower in both cases than the original speed of the first transport belt which is operational upstream of the branching location.

Each conveying path is operatively connected at its end to respectively one continuously operating folding device which, following the folding operation, supplies the signatures straddling, either in the form of an overlapping flow or as individual signatures or sheets, to separate intermediate collecting devices. In turn, these collecting devices are operatively connected to a belt-type main conveying section, preferably operating below, which can also be embodied as gathering chain and is designed to convey the signatures or sheets while spaced apart.

With a serial transfer of the signatures from the separate conveying paths, operating in a tandem arrangement, to the main conveying belt, a high flexibility is obtained for the further processing of these signatures. This flexibility can reach maximum values for the composition of the end product as well as the gathering operation to form the end product, regardless of whether the end product is a wire-stitched, a thread-stitched or an adhesive-bound book block.

The tandem-type transport system according to the invention can be expanded without a problem by dividing the paper web in accordance with a first format expansion of the finished product into a variable number of print-specific partial web sections, wherein each partial web section is imprinted sequentially with all pages of a finished printed product.

Following the printing phase, the paper web is cut continuously in a cross direction, such that the respective cutoff length amounts to a multiple of a second format expansion of the finished printed product. These partial web sections are then transported further accordingly via the respectively allocated conveying paths, either individually or combined, wherein the subsequent folding operations are realized at least once in the lateral or longitudinal direction. A method of this type follows from the document EP 1 270 479, which corresponds to U.S. Application Publication No. 2011/0098169, the latter being incorporated herein by reference.

A gathering section which is supplied with printed products and forms a part of a gathering machine can also be used in place of the main conveying section. In that case, the gathering section is provided with several feeders for respectively supplying the printed products to receiving locations that follow each other at regular intervals along a continuously rotating conveying device. Along the gathering section, the receiving locations of the conveying device are supplied with the aid of at least one feeder, connected to a digital printing press, with sequentially printed products, either in the form of individual signatures or sheets and/or in the form a stack composed of partial book blocks. A method of this type is known from European patent document EP 09405174.5, which corresponds to U.S. Application Publication No. 2011/0079159, the latter being incorporated herein by reference.

As previously explained in the above, the transport system used for producing print items which are composed of wire-stapled or thread-stitched or adhesive-bound printed products is not restricted to two conveying paths. An expansion to a plurality of conveying paths is possible. The parallel or serial feeding of signatures or printed sheets arriving from different conventional or digital printing presses can also be realized without problem using the system according to the invention.

The transport system comprises a control unit which specifies the sequence for combining the signatures or sheets. The number of signatures or sheets which are processed to form an end product should number at least two, based on economic considerations.

The conveying paths which are operational downstream of the first conveying belt can also be operatively connected to additional feeders or feed conveyors which supply supplements or inserts at certain points or continuously to the signatures or printed sheets transported thereon. In case of such an expansion, the belt speeds of the conveying paths as well as the type and inner consistency of the flow of signatures or printed sheets should be adapted correspondingly. As a result, an individualized feeding of the supplements is possible as well.

Advantageous and useful modifications and variants of the solution according to the invention are characterized in the additional dependent claims.

BRIEF DESCRIPTION OF THE DRAWINGS

These and other features and advantages of the invention will be further understood from the following detailed description with reference to the accompanying drawing. All elements not essential to the understanding of the invention are omitted, wherein:

FIG. 1 shows a side view of a schematic representing a transport system for conveying signatures or printed sheets via two conveying paths in a tandem arrangement according to an embodiment of the invention.

DETAILED DESCRIPTION

FIG. 1 shows a printing press C downstream of which printed sheets 1 are initially transported by a first conveying belt 2 in a linear direction and are then guided across a branching location 3 where the product flow is divided and is subsequently conveyed via at least two conveying paths A and B. Along these paths A and B, the printed sheets 1 are rearranged to form an overlapping flow 4, wherein the speeds of the two overlapping flows $V_A$ and $V_B$ on the one hand differ relative to each other while, on the other hand, these speeds are lower than the original speed $V_1$ of the first conveying belt 2 which operates upstream of the branching location 3.

Each of the conveying paths A and B is provided at its end with, respectively, a continuously operating folding device, 5, 6 which, after the folding operation, supplies the folded sheets or signatures 10 in a straddling position to respectively one intermediate gathering device 7, 8. This gathering device is operatively connected to a main conveying belt 9, arranged below, which functions as a gathering chain and is designed for the spaced-apart conveying of the gathered, folded signatures 10, shown herein. The transfer of the signatures from the two conveying paths to the main conveying belt 9 advantageously takes place serially, so as to provide a high flexibility. However, other sequences can also be used as described in the above.

As a result, stacks of signatures can be made available at a following processing station which can then be wire-stapled, thread-stitched, or adhesive bound. On the one hand this is aided by the different speeds $V_A$ and $V_B$ of the conveying paths A and B and, on the other hand, by the serial arrangement of same as compared to the main conveying belt 9.

FIG. 1 does not show in further detail that the conveying paths downstream of the first conveying belt can additionally be operated such that these conveying paths are connected to additional feeders or feed conveyors for feeding supplements at certain locations or continuously to the signatures transported thereon. With this type of expanded operation, the belt speeds of the conveying paths, as well as the type and internal consistency of the signature flow, need to be adapted correspondingly. In the process, it is also possible to supply these supplements or inserts individually.

A supplement feeding of this type can also be realized downstream of the conveying paths, so that the transport system described herein can optionally be expanded by using different elements or configurations.

It will be understood that the above description of the present invention is susceptible to various modifications, changes and adaptations, and the same are intended to be comprehended within the meaning and range of equivalents of the appended claims.

What is claimed is:

1. A method to transport printed products composed of printed sheets or signatures, comprising:

producing printing products with the use of a printing press;

transporting the printed products with at least one first conveying belt operative downstream of the printing press along a conveying path;

dividing the conveying path into at least two individually operating conveying paths at a branching location downstream from the at least one first conveying belt;

folding the respective printed products with a continuously operating folding device located at the end of each of the at least two individually operating conveying paths;

transferring the folded printed products from the folding devices in a straddling position to corresponding intermediate gathering devices;

transferring the straddling folded printed products from the intermediate gathering devices to a main conveying section in a serial, monotonous, intermittent, synchronous or non-synchronous sequence for further transport; and operating the at least two individually operating conveying paths at speeds that are lower than a speed of the at least one first conveying belt which operates upstream of the branching location, and at different speeds relative to each other.

2. The method according to claim 1, maintaining or combining said sequence with at least one different sequence during at least one operating phase.

3. The method according to claim 1, including conveying the printed products along the conveying paths either separately or in an overlapping flow.

4. The method according to claim 3, including changing a guidance of the signatures intermittently.

5. The method according to claim 1, including binding the printed products with wire-staples, thread-stitching or adhesive.

6. The method according to claim 1, including further processing the printed products to form partial book blocks or book blocks.

7. The method according to claim 1, including operating the main conveying section as a main conveying belt.

8. The method according to claim 1, including operatively connecting the at least two individually operating conveying paths to additional devices for feeding of supplements.

9. The method according to claim 1, including continuously changing the speeds of the at least two individually operating conveying paths relative to each other.

10. The method according to claim 1, including continuously changing the speeds of the at least two individually operating conveying paths in cooperation with the at least one first conveying belt.

11. The method according to claim 1, wherein the transferring of the straddling folded printed products from the intermediate gathering devices to the main conveying section includes specifying a sequence for combining the printed sheets or signatures from at least one of the serial, monotonous, intermittent, synchronous and non-synchronous sequences by a control unit that is configured to have the capability to specify any one of the serial, monotonous, intermittent, synchronous or non-synchronous sequences.

* * * * *